US010266285B2

(12) United States Patent
Küffner et al.

(10) Patent No.: US 10,266,285 B2
(45) Date of Patent: Apr. 23, 2019

(54) METHOD AND DEVICE FOR PRODUCING PARTIALLY EMBOSSED BLANKS

(71) Applicant: TSCHEULIN-ROTHAL GMBH, Teningen (DE)

(72) Inventors: Marcel Küffner, Emmendingen (DE); Piotr Walachowski, Zlotów (PL); Krzysztof Luszczewski, Zlotów (PL)

(73) Assignee: TSCHEULIN-ROTHAL GMBH, Teningen (DE)

( * ) Notice: Subject to any disclaimer, the term of this patent is extended or adjusted under 35 U.S.C. 154(b) by 88 days.

(21) Appl. No.: 15/538,001

(22) PCT Filed: Dec. 15, 2015

(86) PCT No.: PCT/EP2015/002520
§ 371 (c)(1),
(2) Date: Jun. 20, 2017

(87) PCT Pub. No.: WO2016/102052
PCT Pub. Date: Jun. 30, 2016

(65) Prior Publication Data

US 2017/0361952 A1 Dec. 21, 2017

(30) Foreign Application Priority Data

Dec. 22, 2014 (EP) ..... 14004352

(51) Int. Cl.
*B31F 1/07* (2006.01)
*B65B 7/01* (2006.01)
(Continued)

(52) U.S. Cl.
CPC ..... *B65B 7/01* (2013.01); *B31D 1/0018* (2013.01); *B31F 1/07* (2013.01); *B41M 1/24* (2013.01);
(Continued)

(58) Field of Classification Search
None
See application file for complete search history.

(56) References Cited

U.S. PATENT DOCUMENTS 8,459,087 B2 6/2013 Konig
2012/0073352 A1 3/2012 Konig

FOREIGN PATENT DOCUMENTS

EP 0960024 B1 2/2002

OTHER PUBLICATIONS

International Search Report for International Application No. PCT/EP2015/02520, dated Feb. 24, 2016—8 Pages.

*Primary Examiner* — Barbara J Musser
(74) *Attorney, Agent, or Firm* — RatnerPrestia

(57) ABSTRACT

A method for producing partially embossed blanks is disclosed. The method is to provide a continuous web of an embossable material, and guide it between two cylinders which emboss its surface. The embossed web is fed to a stamping device to punch blanks from the web. One of the embossing cylinders has a marking which is readable by a first sensor. The first sensor reads the position of the marking and produces a signal which triggers a printing device to produce a print mark on the web identifying the position of the embossing. The print mark is read by a second sensor which produces a signal for controlling and adjusting a feeding distance by which feed rolls supply the web to the stamping device that punches blanks from the web in register with the partial embossing of the blank. A device for conducting the method is also disclosed.

9 Claims, 2 Drawing Sheets

(51) Int. Cl.
*B41M 1/24* (2006.01)
*B31D 1/00* (2017.01)

(52) U.S. Cl.
CPC ..... *B31F 2201/0733* (2013.01); *B31F 2201/0738* (2013.01); *B31F 2201/0761* (2013.01); *B31F 2201/0779* (2013.01); *B31F 2201/0787* (2013.01); *B31F 2201/0792* (2013.01)

METHOD AND DEVICE FOR PRODUCING PARTIALLY EMBOSSED BLANKS

CROSS-REFERENCE TO RELATED APPLICATIONS

This application is a U.S. National Phase Application of PCT International Application PCT/EP2015/002520, filed Dec. 15, 2015 and published Jun. 30, 2016 as WO 2016/102052, which claims priority from European Application No. 14 004 352.2, filed Dec. 22, 2014; each of the aforementioned applications is incorporated herein by reference in its entirety for all purposes.

FIELD OF THE INVENTION

The invention relates to a method for producing partially embossed blanks having an embossed and a non-embossed area and a positioned registered die cut and to a device for producing the same.

BACKGROUND OF THE INVENTION

EP 0 960 024 discloses a method for producing partially embossed cover elements of a film material for sealing containers. The film material contains pre-dimensioned cover elements and is guided between two embossing rollers. The spacing between the cover elements is readable by means of a sensor via pressure marks. A second sensor in an angle position supplies additional values. The values are compared and transmitted to the motor to control the speed of the supply device.

U.S. Pat. No. 8,459,087 discloses a method for producing blanks, the blanks having an embossed surface and being stamped from a continuous material. On the continuous material markings are stamped when the surface of the blank is embossed, said markings being used for the position determination during stamping process.

The blanks disclosed in the instant application are understood as being blanks for covering containers, for example containers in form of cups or trays. Such blanks are widely used as covers for covering cups and trays in the food industry and in the pharmaceutical industry. In particular, the blanks form covers or lids for cups and trays for dairy products etc. Accordingly, the web for the blanks consists of an embossable material. Using the blanks for example as cover or lids in an automated packaging process an embossed pattern is essential to allow an easy separation of the single blanks in an automated process. The embossing of the blanks is not only essential to achieve easily processable blanks, e.g. as mentioned above in terms of de-stacking blanks that are stored in stacks before they are processed further. The embossing additionally provides the possibility to create specific designs on the blanks, e.g. figures or a product name. However, if there are specific designs embossed on the blanks, it becomes desirable that the design has a fixed position on the blank which does not shift in the manufacturing process of the blanks eventually resulting in a mutilated design due to punching of the blank from the web. Thus, the blanks need to be die cut at a defined position in register with the embossing.

The precise positioning of the embossing in connection with the exact die cutting of the embossed blank from continuous web is still difficult to achieve.

BRIEF SUMMARY OF THE INVENTION

The object of the present invention is to provide a simple and efficient method for the production of blanks for lids and covers whereby the embossed blanks are die cut at a defined position in register with the embossing.

The present invention provides a method for producing partially embossed blanks, comprising, providing a continuous web of an embossable material, guiding said web between two embossing cylinders, embossing the surface of the web between the two embossing cylinders, supplying the embossed web to a stamping device at which the blanks are punched at a defined position from the web such that the embossing has a fixed position on a finished blank.

A method according to the instant invention comprises the steps of:

One of the embossing cylinders comprises a marking, said marking being readable by a first sensor, said first sensor reading the position of the marking and producing a signal, said signal triggers a printing device producing a print mark on the web after the embossing step, identifying the position of the embossing, feeding the embossed and marked web, driven by feed rolls, to a stamping device, said print mark produced by the printing device being read by a second sensor, said second sensor producing a signal a) for controlling and adjusting a feeding distance D by which the feed rolls supply the embossed and marked web to the stamping device for punching the partially embossed blanks from the web at a predefined position in register with the partial embossing or b) for adjusting the feed rate of the feed rolls, the feed rolls supplying the embossed and marked web to the stamping device and simultaneously adjusting the punch cycle of the stamping device for punching the blanks from the web along the outer edge of the blank.

DETAILED DESCRIPTION OF THE INVENTION

Figure 1:
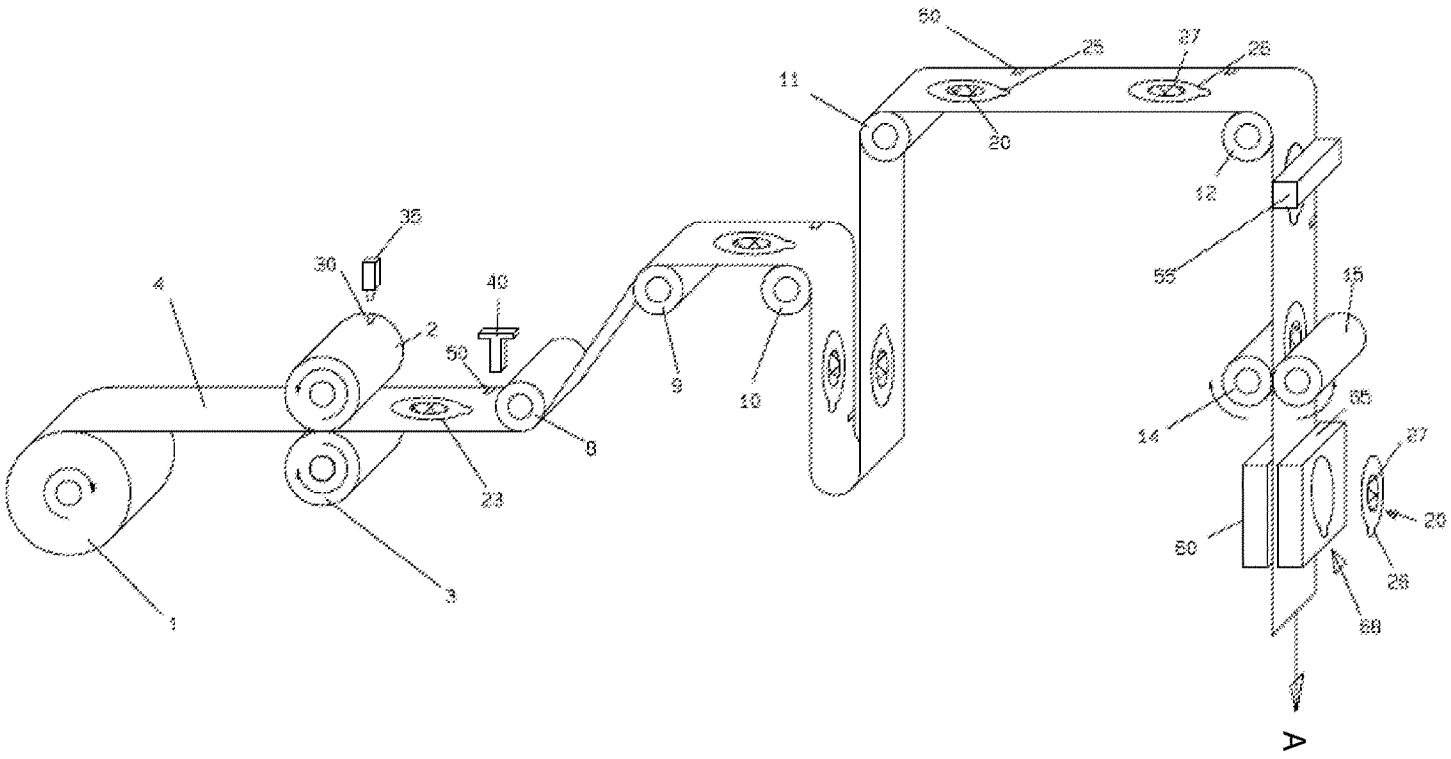
FIG. 1 shows an embodiment of the device.

The embossing cylinders produce an embossing on the web, resulting in a partially embossed web having embossed and non-embossed areas. The print mark produced on the web by the printing device upon reading the marking present on one of the embossing cylinders provides a mark for the position of the embossing. The print mark has always the same relative position on the web with regard to the partial embossing, thereby providing a simple mean to control the feeding distance D which determines the distance how much the web is conveyed by the feed rolls in machine direction to the stamping device thereby positioning the (partial) embossing in register with the stamping device so that the embossing has a predefined position on the finished blank. The reading of the print mark is advantageously more precise than the reading of other marks, such as an indentation.

According to the use, the preferred web materials are packaging materials in the form of foils or films. The foils or films are fed to the instant device in a continuous or endless form. In practice the web materials are wound-up to reels or coils. The reels or coils are inserted or mounted into the device and unwound to be fed to the instant process.

Typical packaging materials are metal foils, such as aluminium foils or aluminium alloy foils. The foils may carry on one or both sides one or more layers of lacquers, sealing lacquers, paints, films or layers of plastic and paper. Useful web material may contain plastic materials only, like one or more of plastic foil or film or cast plastic. Between the layers glues or adhesives may be arranged. The web materials may also contain single or multiple paper layers.

Typical plastic foils are made from polyesters, like standard PET or special forms like A-PET (amorphous PET) or G-PET (PET glycol modified). Different types of biodegradable plastic, for example PLA (Poly Lactic Acid) may be used. Mono-foils or multi-layer foils having two or more single layers of the same or a different material can be used. The thickness of the single foils may vary from 7 to 100 μm, preferably from 7 to 50 μm, in particular from 7 to 25 μm. Composite materials, like laminated or coextruded plastics may have a total thickness of 15 to 100 μm. Useful metal foils in composite materials comprise aluminium, aluminium alloys or steel in a thickness from 7 to 80 μm also with an optional coextrusion coating or a lacquer coating. Instead of metal foils or together with metal foils metalized plastics can be applied. Composites made of metal foils and plastic foils may have a total thickness from 20 to 100 μm. The weight per area, also termed grammage, for papers ranges for example from 20 to 100 g/m$^2$, preferably from 30 to 50 g/m$^2$. Composite materials containing paper and plastic foils and occasionally metal foils, may reach a total thickness in the range of 20 to 300 μm, preferably in the range of 25 to 60 μm and more preferably in the range of 25 to 40 μm. To combine foils, films and papers glues and adhesives, like polyurethane adhesives or extrusions may be used. The web materials may, especially on the side facing outside, carry layers of clear coats, glossy coats, protecting coats or printing. On both surfaces of the web material, or only on the proposed surface, facing the inside of a container to be covered, partially or fully, sealing lacquers, hot seals or sealing films may be present.

Examples of the preferred web materials are:

Aluminium foils in a thickness from 20 to 50 μm optionally printed on one side and having on the other side a layer of hot seal lacquer in an amount from 2 to 10 g/m$^2$ or an extrusion coating in an amount from 10 to 30 g/m$^2$.

A composite material comprising aluminium/plastics/aluminium/hot seal lacquer or extrusion coating; the aluminium layer having a thickness in the range of 7 to 20 μm and the plastics layer having a thickness in the range of 7 to 20 μm, and the hot seal lacquer or extrusion coating in the range of 2 to 30 g/m$^2$.

To perform the inventive method, the web material, usually a packaging material, is supplied to the process preferably in form of a reel or coil and said reel or coil is inserted into an unwinding device. The unwinding device is feeding the embossing device. The unwinding device is equipped with means allowing influencing the movement of the web material into the embossing device, i.e., braking or accelerating the web material. One of the features of the embossing device is two cylinders, namely the embossing cylinder and the counter pressure embossing cylinder. One of the cylinders, features a marking which is arranged preferably along the rim or edge of the roller. The marking may be arranged on either one of the two cylinders, provided the cylinders are made of a hard material. In case the counter pressure embossing cylinder is made of a material other than metal, the marking is arranged on the embossing cylinder. The marking arranged on either one of the two embossing cylinders may be a colored spot, a protrusion or an indentation on the roller. Other means triggering a magnetic field, an electric field, a magneto-electric field, a light reflection or light emission and the like are alternative feasible options. In the path of the marking, rotating on the roller, a stationary first sensor scans the surface of the roller. When the marking is passing the first sensor a signal is triggered and transferred to a computing device. The computing device calculates a signal which is forwarded to and activates a device producing a print mark on the embossed web material. The device producing the print mark is preferably a printer, like an ink jet printer. The print mark may be a marker in a color different in visual contrast comparing to the web and detectable by a reader. Instead of a color print mark the mark on the web could also be an embossing or a hole. However, print marks are preferred over other types of marks. An ink jet printer allows a very precise positioning of the print mark on the web material and the prints are reliably recognized by a downstream second sensor. After the embossing process the web material proceeds to the die cut tool in a stamping device or stamping tool. The second sensor recognizes on the travelling web material the print mark. The second sensor triggers a signal which is sent to the computer system of the stamping device, controlling a feeding distance D by which the feed rolls supply the embossed and marked web to the stamping device for punching the partially embossed blanks form the web at a predefined position in register with the partial embossing.

Alternatively, the second sensor triggers a signal which is sent to feeding rollers. The feeding rollers are located upstream of the stamping device and control the feeding speed or feeding rate of the web material into the stamping device with a die cut tool. Depending on the position of the print mark, the second sensor activates the feeding rollers to accelerate or slowdown the speed or rate of the web material or to accelerate or slowdown the punch cycle. A combination of adjusting the feed roller speed and the punch cycle is an alternative process according to the instant invention.

The optionally printed, embossed and stamped blanks, manufactured along the instant process, form covers or lids for closing cups or trays, for example utilized in the food industry, mainly dairy industry, and pharmaceutical industry. The covers or lids are valuable for closing or sealing containers, like beakers, bowls, bottles, cans, cups, trays and other containers. Typical are containers containing for example yoghurt, cream, sour cream, cheeses, milk, jellos, puddings and preparations thereof. Further uses for the lids and closures include the covering or sealing of containers in the pharmaceutical and cosmetic industry.

While other printers may be used an ink jet printing device is the most preferred printing device.

Preferably, the print mark is printed in the form of a pattern. Such a pattern may be very simple and consist of one line or it consists of several lines that in addition may be arranged in the form of a bar code. In another preferred embodiment the pattern comprises or consists of dots, for instance in the form of circular, quadratic or rectangular form. A simple print mark consists of one dot. The print mark may also consist of more than one dot that is arranged in the form of a matrix or like a QR-code. In a further embodiment the printed pattern comprises at least one graphical element selected from the group consisting of dots, lines, circles, triangles and rectangles.

The instant invention also provides a device for performing the instant method. The device comprises of a continuous web of an embossable material, means for guiding the web, two embossing cylinders for embossing the surface of the web between the two embossing cylinders, means for supplying the embossed web to a stamping device, a stamping device for punching the blanks from the web. One of the embossing cylinders comprises a marking which is arranged preferably along the rim or edge of the roller. Further, the device has a first sensor for reading the position of said marking and producing a signal, a computer for processing said signal to trigger a printing device producing a print mark on the web after the embossing step, a second sensor identifying the position of the embossing, a stamping device, fed by the embossed and marked web by feed rolls, the second sensor for reading said mark and producing a signal a) for controlling and adjusting a feeding distance D by which the feed rolls supply the embossed and marked web to the stamping device for punching the partially embossed blanks from the web at a predefined position in register with the partial embossing or b) for adjusting the feed rate of the feed rolls, the feed rolls supplying the embossed and marked web to the stamping device and simultaneously adjusting the punch cycle of the stamping device for punching the blanks from the web along the outer edge of the blank.

The method for producing partially embossed blanks according to the present invention is explained in more detail below with reference to an exemplary embodiment in the FIG. 1, in which, purely schematically:

FIG. 1 shows an embodiment of the device.

Figure 2A:
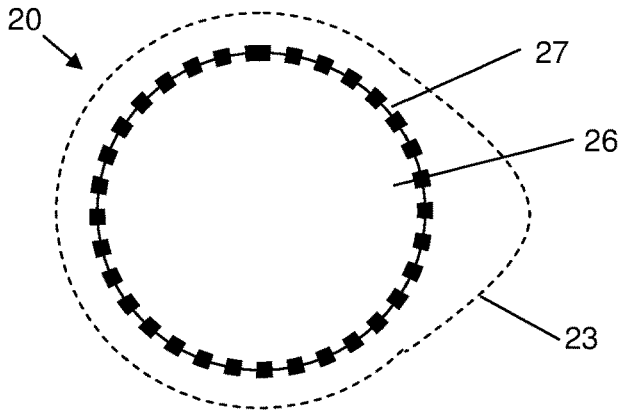
FIG. 2A shows a first embodiment of a partially embossed blank.
Figure 2B:
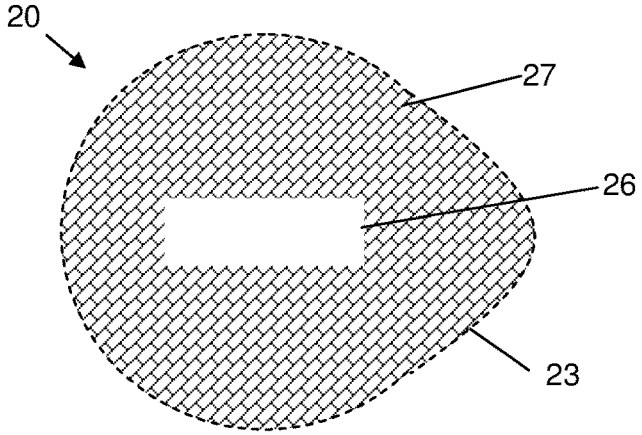
FIG. 2B shows a second embodiment of a partially embossed blank.
Figure 2C:
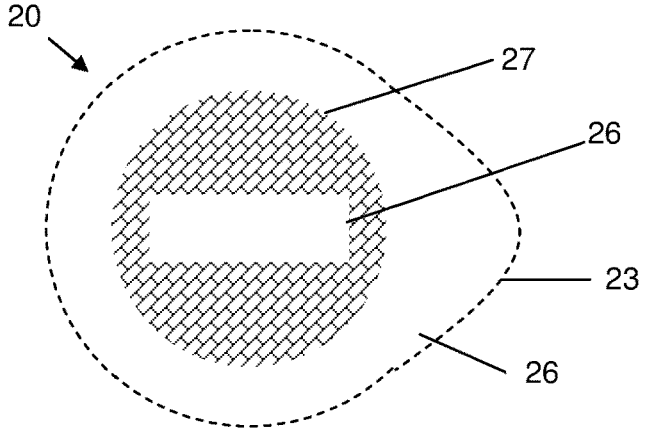
FIG. 2C shows a third embodiment of a partially embossed blank.

FIG. 2A shows a first embodiment of a partially embossed blank;

FIG. 2B shows a second embodiment of a partially embossed blank;

FIG. 2C shows a third embodiment of a partially embossed blank.

As a non-limiting example, a method is illustrated and device for producing single, partially embossed blanks 20 according to the present invention is shown in FIG. 1.

In FIG. 1 is shown a reel or coil 1 containing a continuous or endless web 4 of an embossable material, means like a motor for unwinding the web 4, motor driven embossing cylinders, namely an embossing roller or embossing cylinder 2 and a backing roll or counter pressure embossing cylinder 3, as well as downstream means like rolls 8, 9, 10, 11, 12 for guiding the web 4 in direction of a pair of motor driven feeder rolls 14, 15 and a punching device 68.

In order to adjust the feeding speed of the web 4 in the unwinding station (not shown) to the speed of the web 4 during the embossing process step, the rotational speed of reel 1 can be decelerated, for which means the unwinding station comprises a brake mechanism. The embossing roller 2 and the backing roll 3, i.e. the counter pressure cylinder, serve as means for embossing a part of the free lying surface of web 4 between said motor driven embossing cylinders 2, 3. One of the embossing cylinders, here embossing roller 2, comprises a marking 30 in the form of an indentation or an elevation worked in the embossing cylinder 2. The device further comprises an inkjet print head 40 for producing an inkjet marking 50, i.e. a print mark, on web 4 after the embossing process. All inkjet markings are provided on the same border area of the web 4. The inkjet print mark 50 may be eyemarkings, or may have the form of a dot or a thin stripe or other forms and patterns. Eyemarks are small rectangular printing areas located at or near the edge of a web. The discharge of ink by the inkjet print head 40 is triggered by a signal of a sensor 35 when marking 30 of embossing roller 2 passes sensor 35.

Inkjet markings 50 on web 4 are used to identify the position of the embossing. A contour or outer rim 23 of each partially embossed blank 20 on web 4 is shown for illustration purposes only. The contour or outer rim 23 of the blank 20 is defined by the stamp 60 and the die plate 65 of the stamping device 68, i.e. the outer rim 23 is formed when the blank 20 is punched out from the web 4 by the stamping device 68.

The embossing cylinders 2, 3 form the partial embossing into the web 4. The partial embossing comprises a plain area 26 and an embossed area 27. The outer contour or outer rim 23 is depicted only to better illustrate the plain area 26 of the blank 20. For example, as illustrated in FIGS. 2A and 2C, if the partially embossed blank 20 is intended for use as a lid to be sealed on the rim of a cup, the plain area 26 forms an endless rim for sealing to the cup, and the embossed area 27 is surrounded by the rim.

The continuous web 4 with the consecutively arranged embossed areas 27 of the partially embossed blanks 20 progresses towards a punching device 68 comprising a stamp 60 and a die plate 65. The travelling web 4 is supported and guided by rollers 8, 9, 10, 11, 12. The web part between rollers 10 and 11 is free hanging and serves to compensate the different process speeds of the embossing and the punching processes, especially in regard to the continuous embossing process whereas the punching process is a sequential stepwise process.

A second sensor 55 recognizes print marks 50 each belonging to an embossed area 27 of a partially embossed blank 20 on web 4 and defining the position of the partially embossed blank 20, respectively of the partial embossing on the web.

The print mark 50 reading sensor 55 controls and adjusts a feeding distance D by which the feed rolls (14, 15) supply the embossed and marked web (4) to the stamping device (68) for punching the partially embossed blanks (20) from the web (4) at a predefined position in register with the partial embossing.

Alternatively, the print mark 50 reading sensor 55 triggers the speed of feeder rolls 14, 15 and the activation of the punch stroke of punching device 68. Hence, triggered by the signal from second sensor 55, feeder rollers 14, 15 adjust the feed rate of the web 4 in direction of the punching device 68 and simultaneously the signal from the second sensor 55 adjusts the cycle of the punch stroke. By adjusting the feed rate of web 4 and the cycle of the punch stroke, based on the signal when print mark 50 passes the second sensor 55, the die cut tool or stamp 60 of the punching device 68 punches out the blank 20 from the web 4 exactly at a predefined position in register with the partial embossing of the blank 20.

FIG. 2A shows a first embodiment of a partially embossed blank 20. The embossed area 27 comprises quadratic structures arranged in the form of a circle near the contour or outer rim 23 of the blank 20. Apart from the embossed area 27 of the blank 20 the remaining area 26, i.e., the central part and the rim region of the blank 20, are not embossed.

In FIG. 2B a second embodiment of a partially embossed blank 20 is shown. In this embodiment the plain area 26 is arranged in the form of a rectangle in the center of the blank 20 while the remaining area of the blank 20 is embossed area 27. This means that the embossing extends to the contour or outer rim 23 of the blank 20.

FIG. 2C shows a third embodiment of a partially embossed blank 20. The embossed area 27 is arranged in the form of a circle on the blank 20. A rectangular area in the center of the blank 20 as well as the region between the embossed area 27 and the contour or outer rim 23 is plain area 26.

The invention claimed is:

1. A method for producing partially embossed blanks, each partially embossed blank having an embossed and a non-embossed area, the method comprising the steps of:

providing a continuous web of an embossable material;

guiding said web between two embossing cylinders;

partially embossing the surface of the web between the two embossing cylinders;

supplying the embossed web to a stamping device at which the blanks are punched from the web;

wherein one of the embossing cylinders comprises a marking, said marking being readable by a first sensor, said first sensor reading the position of the marking and producing a signal, said signal triggering a printing device, said printing device producing a print mark on the web after the embossing step thereby identifying the position of the embossing, feeding the embossed and marked web, driven by at least one feed roll to a stamping device, said print mark being read by a second sensor, said second sensor producing a signal for controlling and adjusting a feeding distance D by which the at least one feed roll supplies the embossed and marked web to the stamping device for punching the partially embossed blanks from the web at a predefined position in register with the partial embossing of the blank.

2. A method according to claim 1, wherein the printing device is an ink jet printing device.

3. A method according to claim 2, wherein the print mark is printed in the form of a pattern.

4. A method according to claim 1 wherein the print mark is printed in the form of a pattern.

5. A method according to claim 4, wherein the print mark comprises at least a line.

6. A method according to claim 4, wherein the print mark comprises at least a dot.

7. A method according to claim 4, wherein the print mark comprises at least one graphical element selected from the group consisting of lines, dots, circles, triangles and rectangles.

8. A device for producing partially embossed blanks, the device comprising a continuous web of an embossable material, a guiding device -for guiding the web, two embossing cylinders for embossing the surface of the web between the two embossing cylinders wherein one of the embossing cylinders comprises a marking, a feeder device for supplying the embossed web to a stamping device, the stamping device for punching the blanks from the web, a first sensor for reading the position of said marking and producing a signal, a computer for processing said signal to trigger a printing device- for producing a print mark on the web after the embossing process, a second sensor for identifying the position of the embossing, a stamping device fed with the embossed and marked web by the at least one feed roll, the second sensor- also for reading said print mark and for producing a signal for controlling and adjusting a feeding distance D by which the at least one feed roll supplies the embossed and marked web to the stamping device for punching the partially embossed blanks from the web at a predefined position in register with the partial embossing of the blank.

9. A device according to claim 8, wherein the printing device is an ink jet printing device.

* * * * *